United States Patent [19]

Yamaguchi

[11] Patent Number: 4,513,941

[45] Date of Patent: Apr. 30, 1985

[54] TILE HOLDING DEVICE FOR PRESETTING TILES

[75] Inventor: Masaharu Yamaguchi, Suita, Japan

[73] Assignee: Iwao Jiki Kogyo Kabushiki Kaisha, Saga, Japan

[21] Appl. No.: 544,302

[22] Filed: Oct. 21, 1983

[51] Int. Cl.[3] ..... B32B 3/08; B32B 23/22

[52] U.S. Cl. ..... 249/91; 425/123

[58] Field of Search ..... 249/85, 91; 425/110, 425/117, 123

[56] References Cited

U.S. PATENT DOCUMENTS

| | | | |
|---|---|---|---|
| 2,698,536 | 1/1955 | Robertson | 425/110 |
| 2,781,554 | 2/1957 | Robinson | 425/123 X |
| 2,855,653 | 10/1958 | Kastenbein | 425/110 |
| 2,972,783 | 2/1961 | Russell et al. | 425/123 X |
| 3,192,567 | 7/1965 | Abernethy et al. | 425/123 |
| 3,236,924 | 2/1966 | McClarney et al. | 425/123 X |
| 3,242,549 | 3/1966 | Boeglen | 249/91 X |
| 3,287,782 | 11/1966 | McClarney | 425/110 X |
| 3,490,096 | 1/1970 | Johnson | 425/123 X |
| 3,694,533 | 9/1972 | Kelsey | 425/123 X |
| 3,891,178 | 6/1975 | Kelsey | 425/123 X |
| 4,025,259 | 5/1977 | Howe et al. | 425/123 |

*Primary Examiner*—J. Howard Flint, Jr.
*Attorney, Agent, or Firm*—Armstrong, Nikaido, Marmelstein & Kubovcik

[57] ABSTRACT

A tile holding device for presetting tiles comprises strip-shaped core members attachable to the inner surface of a form panel as arranged in parallel at a required spacing, long joint members made of elastic material and each mountable on the core member, and short joint members made of elastic material and to be arranged between and joined to each two adjacent long joint members. Preferably, the long joint member comprises a mounting portion in the form of an outwardly open channel, an inward projection projecting inward from the center of width of the mounting portion and having a specified height for forming a long joint, and a side projection projecting sidewise from each side of the inner end of the inward projection for engaging tiles. Preferably, the short joint member has a length equal to the distance between the inward projections of the adjacent long joint members and a thickness equal to the height of the inward projections and is provided at the center of its length with an outward spacing projection having a specified height.

3 Claims, 3 Drawing Figures

1
2
2
4
4c
4c
4b
4a
4
4c
4c
4b
4a
6a
6
T

TILE HOLDING DEVICE FOR PRESETTING TILES

BACKGROUND OF THE INVENTION

The present invention relates to a tile holding device for presetting tiles or tile units on the finishing side of a form panel for preparing precast concrete panels or on the inner side of a form panel for pouring concrete at the site of construction so as to set the tiles in place simultaneously with the pouring of concrete.

Conventionally lattice-like rubber joint members or rubber joint frames are used for holding tiles by absorbing dimensional errors of the tiles when presetting the tiles. However, although the rubber joint member or frame can absorb the dimensional errors of tiles to hold them if the errors are within the elastic limit of the member or the frame, it is impossible to hold the tiles because a clearance occurs between the tile and the joint member or frame, or it is difficult to fit the tiles into the frame smoothly and efficiently, when the errors are beyond the elastic limit.

The main object of the present invention, which has overcome the above problem, is to provide a tile holding device by which tiles can be held to a form panel properly even when involving dimensional errors and which assures an efficient tile setting operation.

Throughout the specification and appended claims, the inward-outward relation is based on FIG. 2; the direction from the form panel toward the tiles in the drawing, i.e., the rightward direction in this drawing, is referred to as "inward," and the direction opposite thereto is referred to as "outward."

SUMMARY OF THE INVENTION

The present invention provides a tile holding device comprising a plurality of strip-shaped core members attachable to the inner surface of a form panel as arranged in parallel at a required spacing, a plurality of long joint members made of elastic material and each mountable on the core member, and a plurality of short joint members made of elastic material and to be arranged between and joined to each two adjacent long joint members. Preferably, the long joint member comprises a mounting portion in the form of an outwardly open channel, an inward projection projecting inward from the center of width of the mounting portion and having a specified height for forming a long joint, and a tile engaging side projection projecting sidewise from each side of the inner end of the inward projection. Preferably, the short joint member has a length equal to the distance between the inward projections of the adjacent long joint members and a thickness equal to the height of the inward projections and is provided at the center of its length with an outward spacing projection having a specified height.

Because of the above construction, the present device properly holds tiles to the form panel without any likelihood that the tile will separate off when concrete is poured, even if the tiles have dimensional errors. Accordingly there is no need to use a glue or adhesive for holding the tiles, thus assuring a high work efficiency. Furthermore, the long joint member of elastic material, which is attached to the form panel with the core member interposed therebetween, can be mounted in place accurately and straight.

DESCRIPTION OF THE PREFERRED EMBODIMENT

The present invention will be described below with reference to the drawings.

Figure 1:
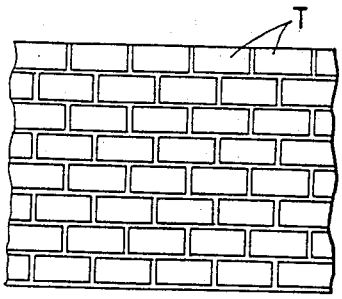
FIG. 1 is a front view showing a wall covered with tiles.
Figure 2:
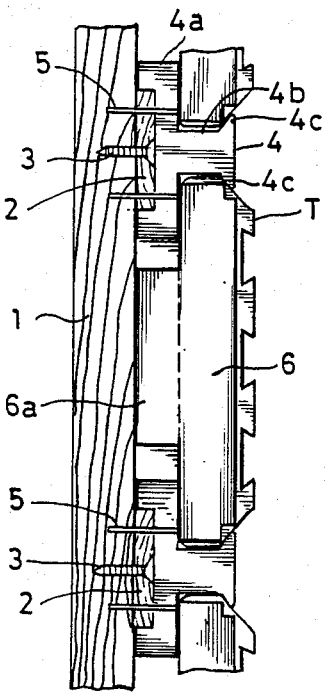
FIG. 2 is a view in vertical section showing tiles held to a form panel by a device of the invention.
Figure 3:
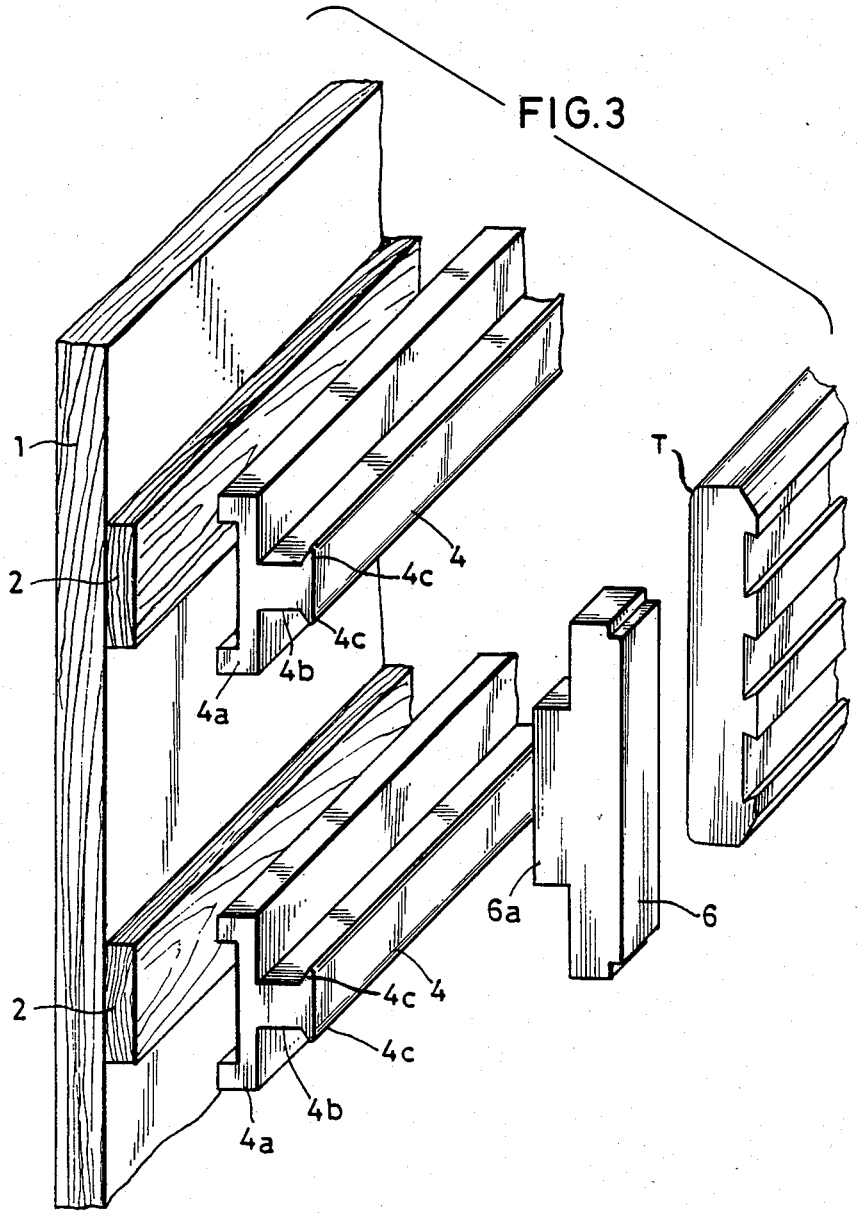
FIG. 3 is an exploded perspective view showing the tile holding device.

Referring to FIGS. 1 to 3, a vertical form panel 1 for preparing a precast concrete panel is pre-marked with a specified pattern on its finishing side. In accordance with the marking, a plurality of strip-shaped core members 2 having a predetermined thickness and made of plywood or synthetic resin plate are arranged horizontally in parallel at a specified spacing and fastened to the panel 1 with screws 3 or staples.

A long joint member 4 made of soft rubber 4 is mounted on each of the core members 2. The long joint member 4 comprises a mounting portion 4*a* in the form of an outwardly open channel, an inward projection 4*b* projecting inward from the center of width of the mounting portion 4*a* and having a specified height for forming a long joint, and a side projection 4*c* projecting sidewise from each side of the inner end of the inward projection 4*b* for engaging tiles. The channel-shaped mounting portion 4*a* is fitted over the core member 2 and fastened to the core member 2 by nails 5 or staples.

Rectangular tiles T are mounted on each two adjacent long joint members 4, with the rear surfaces of the tiles facing inward and their front surfaces bearing on the inner surfaces of the mounting portions 4*a*. The tiles T are chamfered obliquely or stepped at their inside upper and lower corners. The tiles T are retained by the inward projections 4*b* of the adjacent long joint members 4 and have their inside chamfered or stepped portions held in engagement with the opposed side projections 4*c*.

Provided between the tiles T are short joint members 6 made of soft rubber and arranged between and joined to the adjacent long joint projections 4*b*. The short joint member 6 has a length equal to the distance between the inward projections 4*b* of the adjacent long joint members 4 and a thickness equl to the height of the inward projections 4*b* and is provided at the center of its length with an outward projection 6*a* having a specified height and serving as a spacer.

Concrete is poured into the space inside the tiles T thus arranged, the form is removed after curing, the tile holding device of the invention is removed from the arrangement of tiles, and the joint portions are grouted when so desired, whereby a tile-covered wall is obtained as seen in FIG. 1.

Although the order in which tiles and joint members are set is not particularly limited, the short joint members 6 and tiles T are usually alternately arranged between adjacent long joint members 4.

While the long joint members 4 are arranged horizontally on the form panel 1 which is positioned vertically according to the above embodiment, the present invention is of course not limited to this case.

When several kinds of joint members varying in width and/or height are prepared, suitable joint members are selectively usable in accordance with the dimensions of tiles T for forming an attractive tile-set wall with neat joints free of irregularities. If the joint members are classified according to the width and/or height with use of colors for identification, the desired joint members are selectable with ease for an efficient tile setting operation.

What is claimed is:

1. A tile holding device for presetting tiles comprising a plurality of strip-shaped core members 2 attachable to the inner surface of a form panel 1 as arranged in parallel at a required spacing, a plurality of long joint members 4 made of elastic material and each mountable on the core member 2, and a plurality of short joint members 6 made of elastic material and to be arranged between and joined to each two adjacent long joint members.

2. A device as defined in claim 1 wherein the long joint member 4 comprises a mounting portion 4*a* in the form of an outwardly open channel, an inward projection 4*b* projecting inward from the center of width of the mounting portion 4*a* and having a specified height for forming a long joint, and a side projection 4*c* projecting sidewise from each side of the inner end of the inward projection 4*b* for engaging tiles.

3. A device as defined in claim 2 wherein the short joint member 6 has a length equal to the distance between the inward projections 4*b* of the adjacent long joint members 4 and a thickness equal to the height of the inward projections 4*b* and is provided at the center of its length with an outward spacing projection 6*a* having a specified height.

* * * * *